US008437667B2

(12) United States Patent
Handa

(10) Patent No.: US 8,437,667 B2
(45) Date of Patent: May 7, 2013

(54) DEVELOPING APPARATUS CAPABLE OF STIRRING OLD AND NEW DEVELOPER AND IMAGE FORMING APPARATUS HAVING THE DEVELOPING APPARATUS

(75) Inventor: Hiroshi Handa, Inazawa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 845 days.

(21) Appl. No.: 12/362,777

(22) Filed: Jan. 30, 2009

(65) Prior Publication Data

US 2009/0196659 A1 Aug. 6, 2009

(30) Foreign Application Priority Data

Feb. 5, 2008 (JP) ..... 2008-025197

(51) Int. Cl.
*G03G 15/08* (2006.01)

(52) U.S. Cl.
USPC ..... 399/255

(58) Field of Classification Search ..... 399/254–256, 399/258, 260, 262, 263
See application file for complete search history.

(56) References Cited

U.S. PATENT DOCUMENTS 5,160,964 A * 11/1992 Takahashi et al.
5,329,340 A * 7/1994 Fukuchi et al. ..... 399/254
5,493,366 A 2/1996 Satoh et al.
6,047,152 A 4/2000 Hattori et al.
6,456,810 B1 9/2002 Deguchi et al.
7,163,032 B2 1/2007 Itabashi
2006/0177241 A1* 8/2006 Sato et al. ..... 399/254
2007/0189811 A1* 8/2007 Sato ..... 399/254
2007/0258732 A1* 11/2007 Tanaka ..... 399/254

FOREIGN PATENT DOCUMENTS

JP 02103070 A * 4/1990
JP 04063378 A * 2/1992
JP 04-142565 5/1992
JP 05006098 A * 1/1993
JP 06-222665 8/1994
JP 07-056429 3/1995
JP 10-239972 9/1998
JP 2001-100501 4/2001

(Continued)

OTHER PUBLICATIONS

Office Action received for JP Application No. 2008-025197 mailed Feb. 23, 2010.

(Continued)

*Primary Examiner* — Walter L Lindsay, Jr.
*Assistant Examiner* — Milton Gonzalez
(74) *Attorney, Agent, or Firm* — Banner & Witcoff, Ltd.

(57) ABSTRACT

A casing of a developing apparatus defines a developing chamber and a developer accommodating chamber, that accommodates developer, therein. The developing chamber and the developer accommodating chamber are arranged side by side. The casing is formed with a replenishing port for supplying new developer from a developer replenishing unit into the developing chamber. The replenishing port is located right above a supply roller when the developing apparatus is disposed in an orientation in which the developing apparatus is intended to be placed in a main casing of an image forming apparatus. The control unit controls the supply roller to rotate when the developing apparatus is mounted in the main casing. The supply roller stirs old developer that have already been located in the developing chamber and the new developer, and transports the old developer and the new developer from the developing chamber into the developer accommodating chamber.

16 Claims, 9 Drawing Sheets

FOREIGN PATENT DOCUMENTS

| | | | | |
|---|---|---|---|---|
| JP | 2001125353 | A | * | 5/2001 |
| JP | 2004-037779 | | | 2/2004 |
| JP | 2005-010636 | | | 1/2005 |
| JP | 2006-308901 | | | 11/2006 |
| JP | 2007-017866 | | | 1/2007 |
| JP | 2007-206453 | | | 8/2007 |
| JP | 2008-009460 | | | 1/2008 |

OTHER PUBLICATIONS

Office Action for corresponding Japanese Application 2008-025197, mailed Jun. 22, 2010.

* cited by examiner

DEVELOPING APPARATUS CAPABLE OF STIRRING OLD AND NEW DEVELOPER AND IMAGE FORMING APPARATUS HAVING THE DEVELOPING APPARATUS

CROSS REFERENCE TO RELATED APPLICATION

The present application claims priority from Japanese patent application No. 2008-025197 filed Feb. 5, 2008. The entire contents of the priority application are incorporated herein by reference.

TECHNICAL FIELD

The present invention relates to an image forming apparatus and a developing apparatus.

BACKGROUND

Japanese Patent Application Publication No. H06-222665 discloses a developing apparatus that toner cartridge is detachably mounted on the top of the main casing. In a developing apparatus of this type, toner is supplied from the toner cartridge to a toner hopper, thence into the developing chamber that accommodates a developing roller and a supply roller. In the developing chamber, the toner is supplied onto the supply roller. As the supply roller and the developing roller rotate in contact, the toner is supplied to the developing roller. Then, the toner is supplied from the developing roller to the electrostatic latent image formed on the circumferential surface of the photosensitive drum. As a result, the electrostatic latent image is developed.

SUMMARY

When the toner cartridge is removed from the developing apparatus and a fresh toner cartridge is inserted into the developing apparatus, the toner degraded in charging characteristics (degraded toner) remains in the developing chamber. When the fresh toner is supplied from the fresh toner cartridge into the developing chamber, since the charging characteristics is different between the fresh toner and the degraded toner, electric charges are transferred between the fresh toner and the degraded toner, causing electrostatic cohesion of toner. The electrostatic cohesion degrades the quality of an image formed on a recording medium. This phenomenon occurs until the ratio of the degraded toner to the fresh toner falls below a specific value.

In view of the foregoing, an object of this invention is to provide an image forming apparatus and a developing apparatus, each capable of suppressing the degradation of image quality when new developer is supplied to the developing chamber.

To achieve the above and other objects, one aspect of the invention provides an image forming apparatus including a main casing, a developing apparatus, and a control unit. The developing apparatus is detachably mounted in the main casing and includes a casing and a supply roller. The casing defines a developing chamber and a developer accommodating chamber, that accommodates developer, therein. The developing chamber and the developer accommodating chamber are arranged side by side. The casing is formed with a replenishing port for supplying new developer from a developer replenishing unit, that accommodates the new developer, into the developing chamber. The supply roller is disposed in the developing chamber. The replenishing port is located right above the supply roller when the developing apparatus is disposed in an orientation in which the developing apparatus is intended to be placed in the main casing. The control unit controls the supply roller to rotate when the developing apparatus is mounted in the main casing. The supply roller stirs old developer that have already been located in the developing chamber and the new developer, and transports the old developer and the new developer from the developing chamber into the developer accommodating chamber.

In another aspect of the present invention, there is provided a developing apparatus including a casing and a supply roller. The casing defines a developing chamber and a developer accommodating chamber, that accommodates developer, therein, and includes a first wall and a second wall that is positioned at a lower side of the first wall when the casing is disposed in an orientation in which the casing is intended to be placed. The developing chamber and the developer accommodating chamber are arranged side by side. The casing further includes a partition wall that extends from the second wall toward the first wall and has one end portion that is closest to the first wall. The partition wall is interposed between the developing chamber and the developer accommodating chamber. The casing is formed with a replenishing port for supplying new developer from a developer replenishing unit, that accommodates the new developer, into the developing chamber. The supply roller is disposed in the developing chamber and has an outer circumferential surface. The replenishing port is located right above the supply roller when the casing is disposed in the orientation. A position, that is closest to the first wall, of the outer circumferential surface is positioned above the one end portion of the partition wall when the casing is disposed in the orientation.

DETAILED DESCRIPTION

Figure 1:
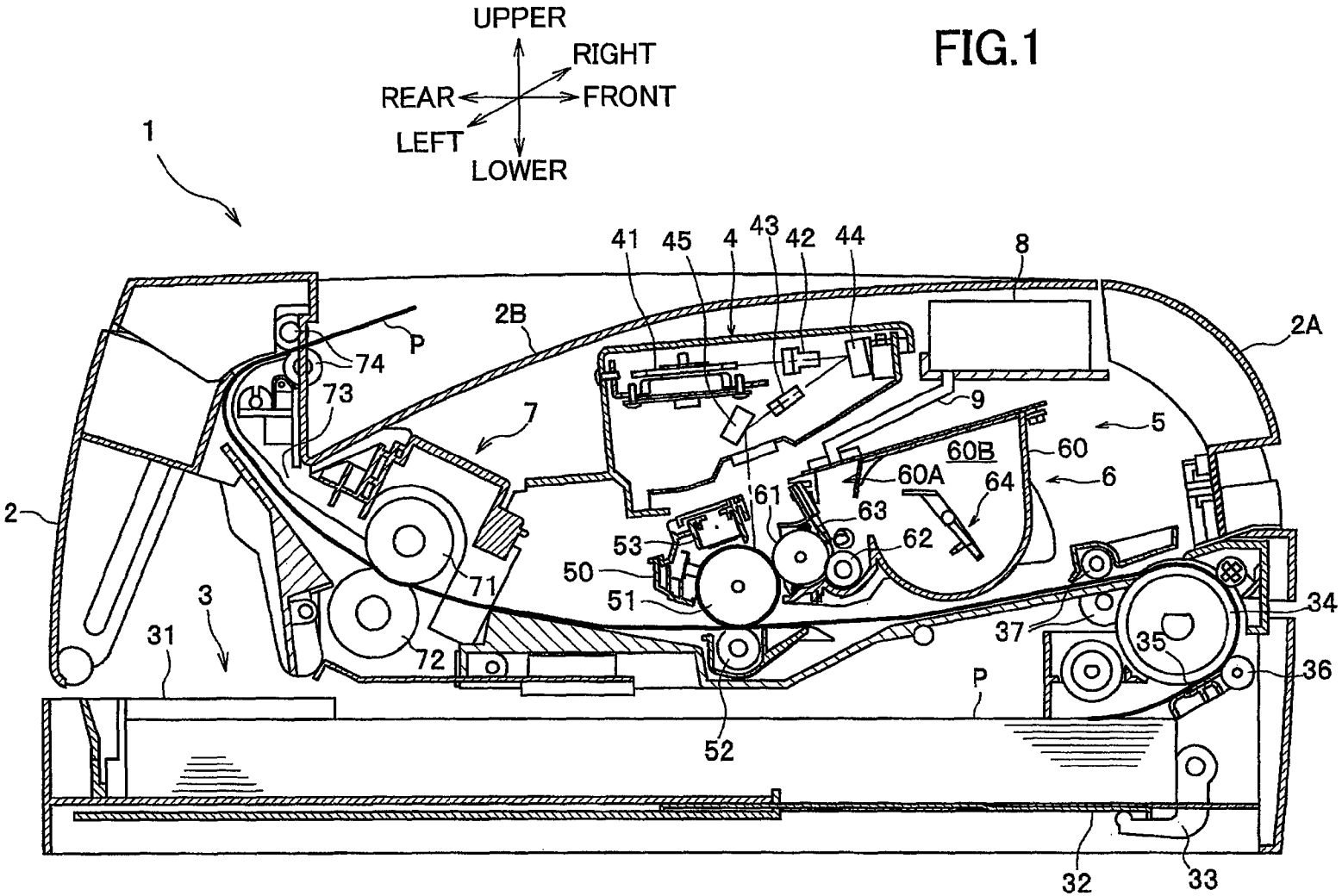
FIG. 1 is a side cross-sectional view showing the overall configuration of a laser printer, which is an example of an image forming apparatus, according to embodiments of the present invention.

An image forming apparatus and a developing apparatus according to embodiments of the present invention will be described while referring to the accompanying drawings wherein like parts and components are designated by the same reference numerals to avoid duplicating description. FIG. 1 is a side cross-sectional view showing the overall configuration of a laser printer 1 serving as an example of an image forming apparatus of the present invention.

In the following description, various directions are used based on a state that a user uses the laser printer 1 and the user mounts a process cartridge 5 on the laser printer 1. More specifically, in FIGS. 1 and 2, the right side is "front side," the left side is "rear side," the side behind the plane of the drawing is "right side," and the side forward the plane of the drawing is "left side." Further, in FIGS. 1 and 2, a direction orthogonal to both of the front-to-rear direction and the left-to-right direction is refereed to as the vertical direction.

[Overall Configuration of the Laser Printer]

As shown in FIG. 1, the laser printer 1 includes a main casing 2, within the main casing 2, a sheet-feeding unit 3, an exposure device 4, a process cartridge 5, a fixing device 7, and a toner box 8. The sheet-feeding unit 3 feeds a sheet of paper P (recording sheet). The process cartridge 5 forms a toner image (developer image) on a sheet of paper P. The fixing device 7 is configured to fix the toner image on the paper sheet P. The toner box 8 is an example of a developer-replenishing device. A front cover 2A is provided on the front side of the main casing 2, and is capable of opening and closing over an opening of the main casing 2. When the front cover 2A is opened, the opening is exposed. Thus, the process cartridge 5 and the toner box 8 can be removed from and inserted into the main casing 2 through the opening.

The sheet-feeding unit 3 is disposed on the lower section of the main casing 2. The sheet-feeding unit 3 includes a paper tray 31, a sheet-pressing plate 32, a lift lever 33, a feeding roller 34, a feeding pad 35, a pinch roller 36, and a registration roller 37. The paper tray 31 is detachably provided in the main casing 2. The sheet-pressing plate 32 is arranged in the front section of the paper tray 31, and is pivotably supported on the rear end thereof. The lift lever 33 is provided in the front section of the sheet-pressing plate 32 for lifting the front end of the sheet-pressing plate 32 upward from below. The registration rollers 37 are provided at the rear side of the sheet-feeding roller 34. The sheet-pressing plate 32 and the lift lever 33 push the sheets of paper P in the paper tray 31, onto the feeding roller 34. Hence, the feeding roller 34 and the feeding pad 35 convey a topmost sheet of paper P between the feeding roller 34 and pinch roller 36. The conveyed paper P passes between the feeding roller 34 and the pinch roller 36 and is conveyed to the registration rollers 37. Thus, the sheet of paper P is conveyed one sheet at a time. After adjusting the registration of the paper P, the registration rollers 37 convey the sheet of paper P to a transfer position in the process cartridge 5 (a position between a photosensitive drum 51 and a transfer roller 52 described later at which a toner image formed on the photosensitive drum 51 is transferred onto the paper P).

The exposure device 4 is arranged in the upper section of the main casing 2. The exposure device 4 includes a laser unit (not shown), a polygon mirror 41 that can be driven to rotate, lenses 42 and 43, and reflectors 44 and 45. The laser light unit emits a laser beam based on image data. As indicated by a chain line in FIG. 1, the laser beam is reflected by the polygon mirror 41, passes through the lens 42, is reflected by the reflector 44, passes through the lens 43, and is reflected downward by the reflector 45 to be irradiated on the surface of the photosensitive drum 51 described later of the process cartridge 5 in a high-speed scan.

The process cartridge 5 is detachably mounted in the main casing 2 beneath the exposure device 4. The process cartridge 5 includes a process casing 50, with in the process casing 50, the photosensitive drum 51, a transfer roller 52, a charger 53, and a developer cartridge 6.

The developer cartridge 6 is detachably mounted on the process casing 50. The developer cartridge 6 has a developing case 60 defining a developing chamber 60A and a toner receptacle 60B accommodating toner (developer). The developer cartridge 6 includes a developing roller 61, a supply roller 62, a layer-thickness regulating blade 63, and an agitator 64. The developing roller 61, supply roller 62 and layer-thickness regulating blade 63 are disposed in the developing chamber 60A. The agitator 64 is disposed in the toner receptacle 60B.

In the process cartridge 5 so configured, the charger 53 applies a uniform charge to the outer surface of the photosensitive drum 51. The laser beam emitted from the exposure device 4 is scanned at a high speed over the outer surface of the photosensitive drum 51. Any surface part of the photosensitive drum 51, applied with the laser beam, has a lower electrical potential. An electrostatic latent image based on the image data is thereby formed on the outer surface of the photosensitive drum 51.

At this point, the agitator 64 rotates, supplying the toner from the toner receptacle 60B into the developing chamber 60A and onto the supply roller 62. The toner is supplied from the supply roller 62 onto the developing roller 61 as the supply roller 62 contacts the developing roller 61 with pressure, the supply roller 62 rotates counterclockwise direction in FIG. 1, and the developing roller 61 rotates counterclockwise direction in FIG. 1. As the developing roller 61 rotates, the toner supplied on the developing roller 61 passes between the developing roller 61 and layer-thickness regulating blade 63, thereby maintaining a uniform thickness of toner on the surface of the developing roller 61.

The toner is applied from the developing roller 61 to the electrostatic latent image formed on the photosensitive drum 51, as the developing roller 61 and the photosensitive drum 51 rotate in contact with each other. As a result, the electrostatic latent image on the photosensitive drum 51 is rendered visible, forming a toner image. The toner image is transferred to a sheet of paper P while the paper P is transported through the nip between photosensitive drum 51 and the transfer roller 52.

The fixing device 7 is disposed rearward of the process cartridge 5 (downstream the process cartridge 5 in the feeding direction of a sheet of paper P). The fixing device 7 includes a heating roller 71 and a pressure roller 72. The pressure roller 72 contacts the heating roller 71 with pressure, thereby being capable of holding a sheet of paper P between the pressure roller 72 and the heating roller 71. At the downstream side of the fixing device 7, a sheet-ejecting path 73 and a sheet-ejecting roller 74 are disposed. The toner image on a sheet of sheet P is thermally fixed as the sheet P passes through the nip between the heating roller 71 and pressure roller 72. The sheet-ejecting roller 74 ejects any sheet of paper P transported from the fixing device 7 to the sheet-ejecting path 73, onto a paper-ejecting tray 2B that is provided on the top surface of the main casing 2.

The toner box 8 accommodates toner for supplying to the developer cartridge 6 and is disposed above the developer cartridge 6 and in front of the exposure device 4. The toner box 8 is detachably mounted on the main casing 2. The toner box 8 is formed with a port at the lower and rear side thereof. In the toner box 8, a transport member (not shown) is provided for transporting toner toward the port (from the front side to the rear side). A drive mechanism is provided in the main casing to apply a drive force to the transport member if the toner box 8 has been set in the main casing 2 and the front cover 2A has been closed. It is noted that the toner in the toner box 8 is continuously supplied from the toner box 8 into the developing chamber 60A.

A replenishing tube 9 is provided in the main casing 2, extending between the process cartridge 5 and toner box 8. The replenishing tube 9 is connected at one end (upper end) to the port of the toner box 8, and at the other end (lower end) to a replenishing port 60C described later of the developer cartridge 6. The replenishing tube 9 is released from the toner box 8 and the replenishing port 60C when the process cartridge 5 and the toner box 8 are attached to or removed from the main casing 2. When the toner box 8 is attached to the main casing 2 and the front cover 2A is closed, the transport member starts transporting toner in the toner box 8 toward the port. The toner falling through the port is supplied into the developer cartridge 6 through the replenishing tube 9. Note that another transport member such as an auger may be provided in the replenishing tube 9.

Since the replenishing tube 9 connects the developer cartridge 6 to the toner box 8 (that is, the developer cartridge 6 and the toner box 8 communicate with each other through the replenishing tube 9), the degree of freedom of positioning the toner box 8 in the main casing 2 increases, thereby enhancing the degree of freedom of design of the laser printer 1.

The toner, remaining in the developing chamber 60A, that has degraded charging characteristics (hereinafter called degraded (old) toner), and the toner supplied from the toner box 8 into the chamber 60A (hereinafter called fresh (new) toner) are mixed in the developing chamber 60A. The configuration that mixes the degraded toner and the fresh toner in the developing chamber 60A and then supplies the mixed toner to the toner receptacle 60B will be described below.

[First Embodiment]

Figure 2:
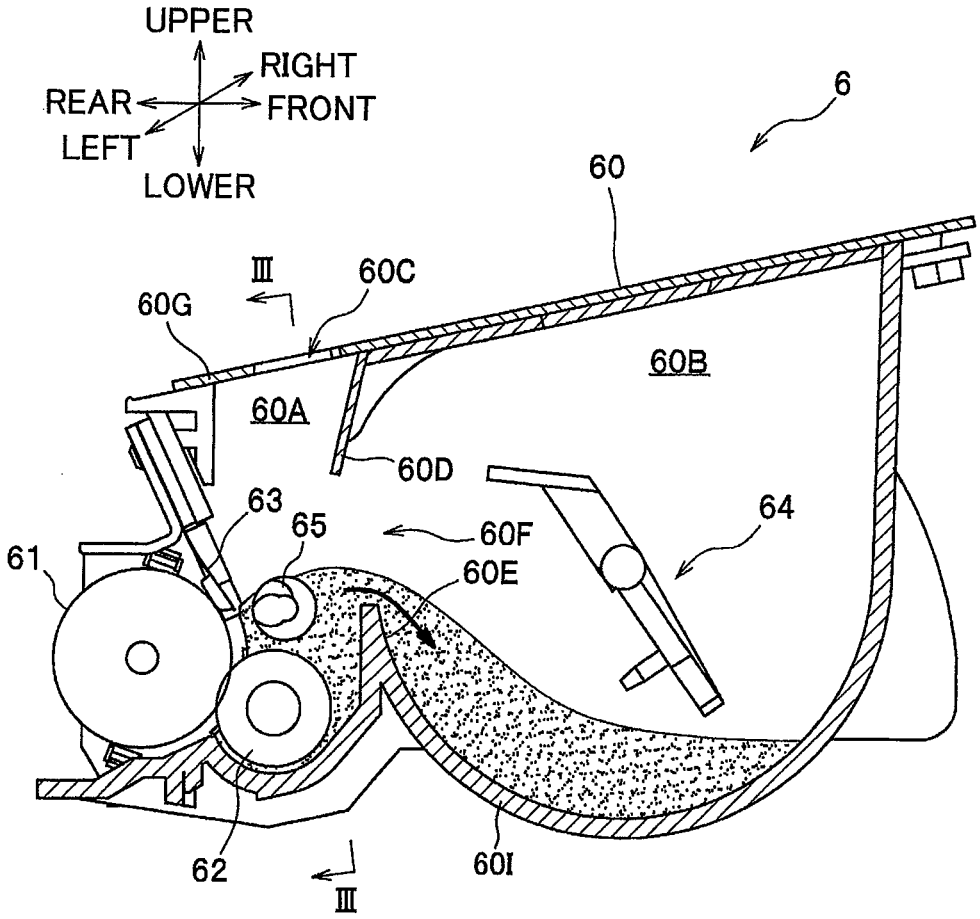
FIG. 2 is a side cross-sectional view showing the configuration of a developing cartridge according to a first embodiment of the present invention.
Figure 3A:
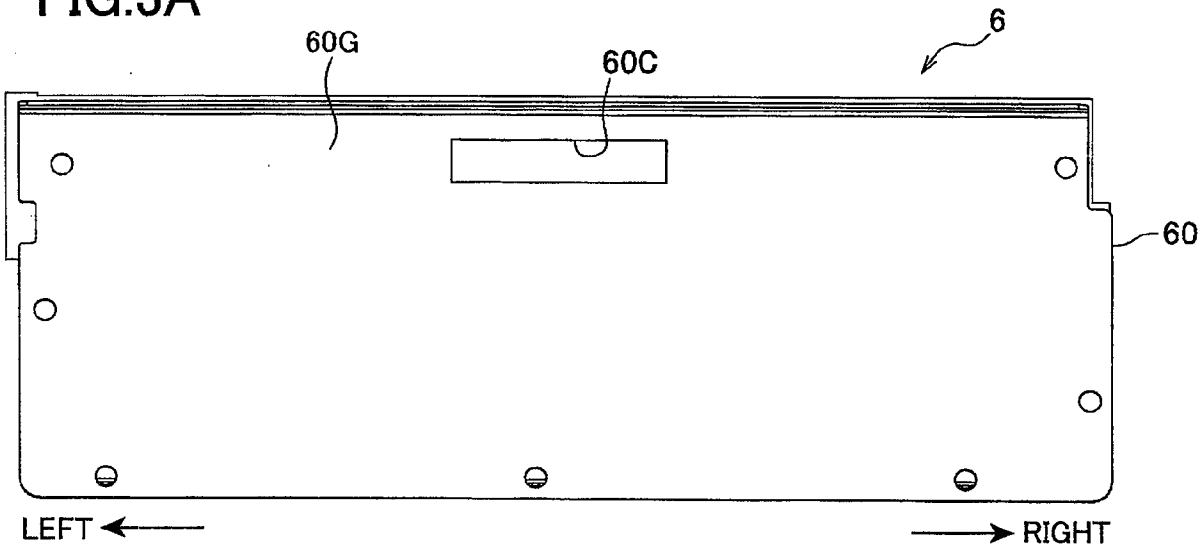
FIG. 3A is a plan view of the developing cartridge according to the first embodiment.
Figure 3B:
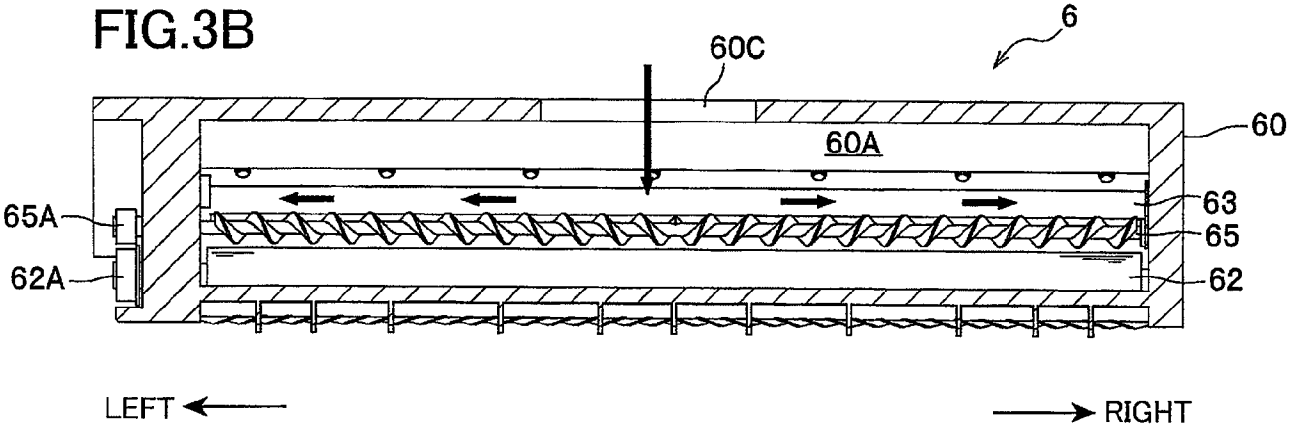
FIG. 3B is a cross-sectional view of the developing cartridge, taken along line III-III shown in FIG. 2.
Figure 4:
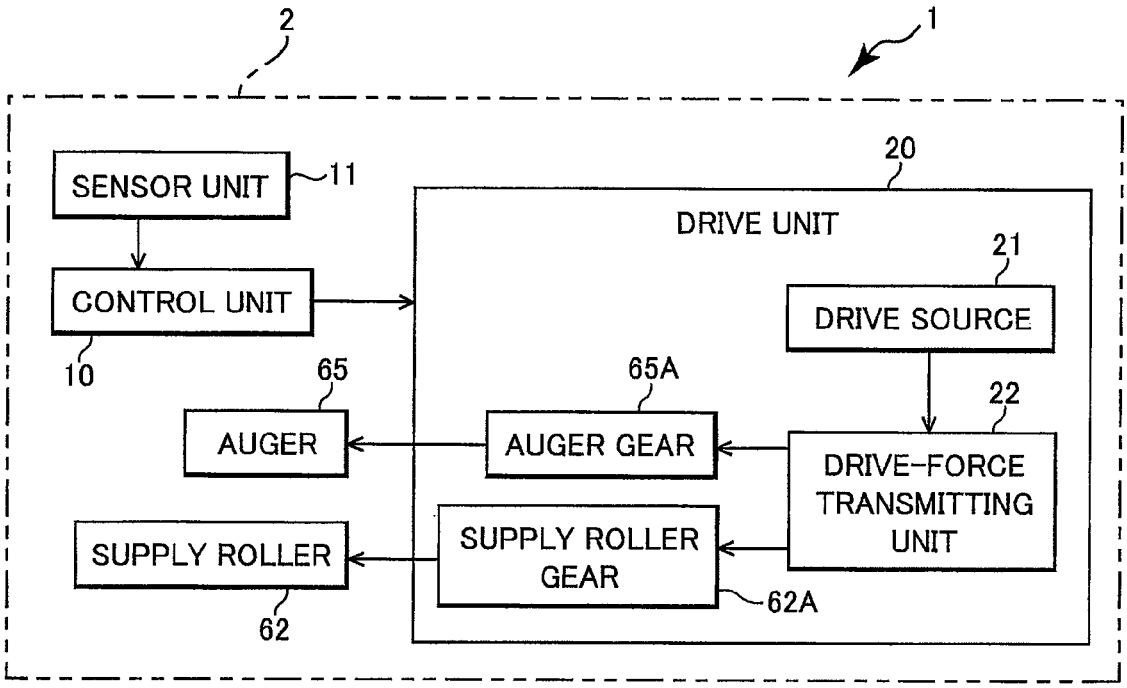
FIG. 4 is a block diagram illustrating the configuration of the laser printer according to the first embodiment.

FIG. 2 is a side cross-sectional view showing the configuration of the developer cartridge 6. FIG. 3A is a plan view of the developer cartridge. FIG. 3B is a cross-sectional view of the developer cartridge 6, taken along line III-III shown in FIG. 2. FIG. 4 is a block diagram illustrating the configuration of the laser printer.

In the following description, directions based on the state where the developer cartridge 6 (process cartridge 5) is mounted in the main casing 2 will be referred to.

As shown FIG. 2, the developer cartridge 6 includes an auger 65 in addition to the developing roller 61, supply roller 62, layer-thickness regulating blade 63 and agitator 64. The developing roller 61, supply roller 62, layer-thickness regulating blade 63 and auger 65 are disposed in the developing chamber 60A. The agitator 64 is disposed in the toner receptacle 60B.

The upper wall 60G defining the developing chamber 60A is formed with the replenishing port 60C at the upper side of (right above) the supply roller 62. The inside of the developing chamber 60A is in communication with the outside of the developing chamber 60A through the replenishing port 60C in the vertical direction. The fresh toner is supplied from the toner box 8 into the developing chamber 60A through the replenishing port 60C. As shown in FIGS. 2 and 3A, the replenishing port 60C is formed in the center part of the upper wall 60G defining the developing chamber 60A. The upper wall 60G defining the developing chamber 60A has the rectangular shape extending in the left-to-right direction.

The developing chamber 60A and the toner receptacle 60B are formed side by side in the front-to-rear direction (horizontal direction). They are separated from each other by an upper partition wall 60D and a lower partition wall 60E that are provided in the developing case 60. The upper partition wall 60D extends downward from the upper wall 60G of the developing case 60. The lower partition wall 60E extends upward from a lower wall 60I of the developing case 60. The space between the upper partition wall 60D and lower partition wall 60E defines a communication passage 60F, through which toner may pass back and forth between the developing chamber 60A and the toner receptacle 60B. The communication passage 60F connects the developing chamber 60A and toner receptacle 60B in the front-to-rear direction (horizontal direction).

The total toner storage capacity of the developing chamber 60A and toner receptacle 60B of the developing case 60 is greater than the toner storage capacity of the toner box 8. As shown in FIG. 1, the toner storage capacity of the developing chamber 60A is smaller than that of the toner box 8.

The auger 65 is rotatably supported on the developing case 60. The auger 65 is disposed right below the replenishing port 60C, above the supply roller 62 and adjacent thereto. The auger 65 supplies the fresh toner supplied through the replenishing port 60C, in the left-to-right direction, i.e., the axial direction of the supply roller 62. More specifically, as shown in FIG. 3B, the fresh toner supplied from the toner box 8 into the developing chamber 60A via the replenishing tube 9 and replenishing port 60C falls onto the middle part of the auger 65 and is then transported to the left or right side from the middle part of the auger 65 as the auger 65 is rotated.

As indicated above, the auger 65 is disposed "right below" the replenishing port 60C. This means that at least one part of the auger 65 overlaps the replenishing port 60C in the vertical direction, as the port 60C is viewed from above, while the process cartridge 5 (developer cartridge 6) remains mounted in the main casing 2.

As shown in FIG. 3B, the shafts of the supply roller 62 and auger 65 (both not identified with reference numbers) project, at left end, from the developing case 60. On the projecting portions (left ends) of the shafts, a supply roller gear 62A and an auger gear 65A that constitute a drive unit 20 are mounted and secured, respectively. When drive forces are exerted on these gears 62A and 65A, the supply roller 62 and auger 65 are driven and rotated.

As FIG. 4 shows, the laser printer 1 includes a control unit 10, a sensor unit 11, and the drive unit 20, in addition to the sheet-feeding unit 3, exposure device 4, process cartridge 5, fixing device 7 and toner box 8. Both the control unit 10 and the drive unit 20 are provided in the main casing 2.

The control unit 10 is disposed in an appropriate position in the main casing 2. The control unit 10 includes, for example, a CPU, a RAM, a ROM, and an input/output circuit, which are not shown. The control unit 10 controls the drive unit 20 and the transport member (not shown) provided in the toner box 8, based on the programs and data stored in the ROM and the outputs from the sensor unit 11.

In this embodiment, the control unit 10 controls the drive unit 20 on three conditions, (1) the process cartridge 5 being mounted in the main casing 2; (2) the toner box 8 being mounted in the main casing 2, and (3) the front cover 2A being closed. Then, the control unit 10 controls the drive unit 20 to drive at least the supply roller 62 and the auger 65, and also to drive the transport member provided in the toner box 8. That is, in this embodiment, the control unit 10 determines that "the developing device (the developer cartridge 6) is mounted in the main casing of the apparatus" when the conditions (1) to (3) are all satisfied.

Any one of the three conditions (1) to (3) may not be satisfied. For example, the front cover 2A may be opened, though the process cartridge 5 and the toner box 8 are mounted in the main casing 2, or the process cartridge 5 may be removed from the main casing 2, though the toner box 8 is mounted in the main casing 2 and the front cover 2A is closed. In these cases, the control unit 10 does not control the drive unit 20. Therefore, neither the supply roller 62 nor the auger 65 will be driven at all.

The sensor unit 11 includes at least a sensor for detecting the attachment of the process cartridge 5, a sensor for detecting the attachment of the toner box 8, and a sensor for detecting opening and closing of the front cover 2A. These sensors are arranged at appropriate positions in the main casing 2.

The above configuration prevents the toner from supplying to the process cartridge 5 when the process cartridge 5 is not mounted in the main casing 2. Further, since the front cover 2A is closed, the process cartridge 5 cannot be removed from the main casing 2 as long as the supply roller 62 and the auger 65 are driven.

The drive unit 20 mainly includes a drive source 21 (e.g., electric motor), a drive-force transmitting unit 22, the supply roller gear 62A, and the auger gear 65A. The drive-force transmitting unit 22 is composed of gears for transmitting a drive force of the drive source 21. The control unit 10 controls the drive source 21 and changes the meshing of the gears in the drive-force transmitting unit 22, thereby controlling the drive of the supply roller 62 and the auger 65.

The effects of the laser printer 1 so configured as described above will be explained below.

When a well-known detecting unit determines that no toner remains in the developer cartridge 6 (toner receptacle 60B), the user first opens the front cover 2A, then removes the toner box 8, next mounts a new toner box 8 in the main casing 2, and finally closes the front cover 2A.

Then, the sensor unit 11 detects a change from one state that the process cartridge 5 and the toner box 8 are not mounted in the main casing 2 and the front cover 2A is opened, to another state that the process cartridge 5 and the toner box 8 are mounted in the main casing 2 and the front cover 2A is closed. The sensor unit 11 outputs a signal indicating a detecting result to the control unit 10. Upon receiving this signal, the control unit 10 controls the drive unit 20 (or another control mechanism (not shown)) to drive the transport member (not shown) provided in the toner box 8, and controls the drive source 21 or drive-force transmitting unit 22 of the drive unit 20. The supply roller 62 and the auger 65 are thereby driven.

Then, the transport member transports the fresh toner in the toner box 8, toward the rear side of the toner box 8 (see FIG. 1). Thus transported, the fresh toner falls through the replenishing tube 9 into the developing chamber 60A. In the developing chamber 60A, the fresh toner supplied in large quantities mixes with the degraded toner remaining in the developing chamber 60A. (That is, the fresh toner and the degraded toner can be existed together in the developing chamber 60A.)

In the developing chamber 60A, the fresh toner and the degraded toner are transported in the left-to-right direction (the axial direction of the supply roller 62) as the auger 65 rotates. The fresh toner and the degraded toner are thereby stirred and uniformly mixed. Since the auger 65 is disposed above and adjacent to the supply roller 62, the upper portion of the supply roller 62 serves as bottom surface of the developing chamber 60A. The mixed toner is thereby reliably stirred and transported from the middle part of the supply roller 62, farther to the left and right ends of the supply roller 62. Moreover, the fresh toner can reliably fall through the replenishing port 60C onto the auger 65, because the auger 65 is arranged right below the replenishing port 60C.

The toner falling from the auger 65 onto the supply roller 62 is further stirred by rotating the supply roller 62. Hence, the fresh toner and the degraded toner can be mixed more uniformly. The resultant mixed toner accumulates on the supply roller 62 (i.e., the bottom surface of the developing chamber 60A) and flows by rotating the supply roller 62. More precisely, the mixed toner flows into the toner receptacle 60B that is positioned next to the developing chamber 60A in the front-to-rear direction. Thus, the degraded toner can be transported, together with the fresh toner, from the developing chamber 60A to the toner receptacle 60B.

The developer cartridge 6 is so designed that the total toner storage capacity of the developing chamber 60A and toner receptacle 60B is greater than the toner storage capacity of the toner box 8, and the toner storage capacity of the developing chamber 60A is smaller than that of the toner box 8. Therefore, the degraded toner in the developing chamber 60A can be mixed with the fresh toner at high efficiency. Further, the degraded toner can be transported into the toner receptacle 60B, without remaining in the developing chamber 60A. The degraded toner can thereby be mixed with the fresh toner at high efficiency, and can be reliably transported into toner receptacle 60B.

Since the fresh toner is continuously supplied from the toner box 8 into the developing chamber 60A, in the developing chamber 60A, the degraded toner is uniformly mixed with the fresh toner and moved to the toner receptacle 60B by continuously performing the above-mentioned toner mixing process. As a result, the ratio of the degraded toner to the fresh toner can be fast reduced in the developing chamber 60A. This can quickly replace most degraded toner remaining in the developing chamber 60A with the fresh toner.

Note that the supply roller 62 is rotated in the clockwise direction in FIG. 2, at least while the fresh toner is being supplied from the toner box 8. If the supply roller 62 is so rotated, the degraded toner can be effectively transported from the developing chamber 60A to the toner receptacle 60B. Further, desirably, the agitator 64 should be stopped while the toner is being supplied from the toner box 8. If the agitator 64 is so stopped, the toner is no longer transported, which can prevent the toner from moving in the direction opposite to the direction in which the toner is transported by the supply roller 62. This enables the supply roller 62 to move the degraded toner from the developing chamber 60A to the toner receptacle 60B more readily.

According to the laser printer 1, when the fresh toner is supplied from the toner box 8, the degraded toner remaining in the developing chamber 60A is uniformly mixed with the fresh toner. Then, the resultant mixed toner is transported into the toner receptacle 60B. The degraded toner can thereby be replaced fast with the fresh toner in the developing chamber 60A. Hence, the ratio of the degraded toner to the fresh toner can be reduced in the developing chamber 60A even immediately after supplying the fresh toner to the developing chamber 60A. The degradation of image quality, which occurs as the fresh toner is supplied, can therefore be more suppressed than in the conventional apparatus.

Figure 5A:
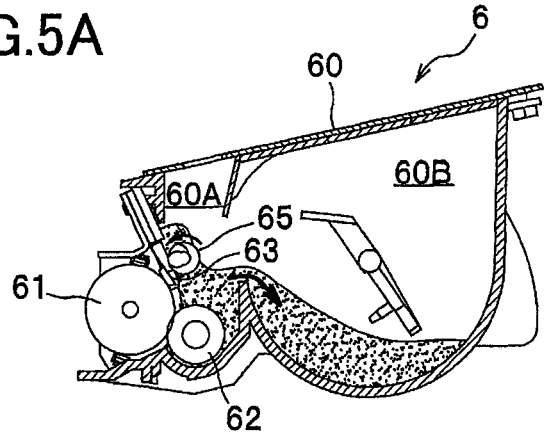
FIGS. 5A to 5C are side cross-sectional views of the developing cartridges, each showing the auger located in a different position according to modifications to the first embodiment.
Figure 5B:
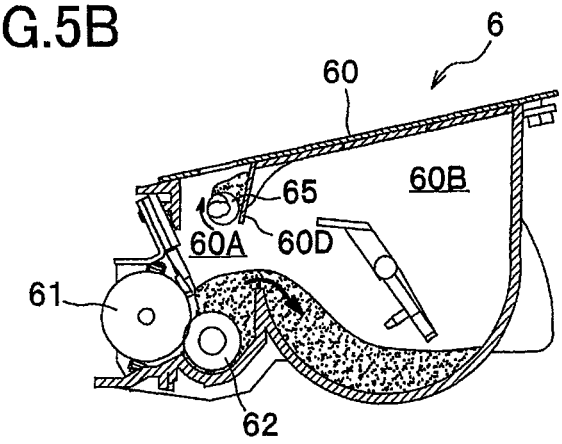
Figure 5C:
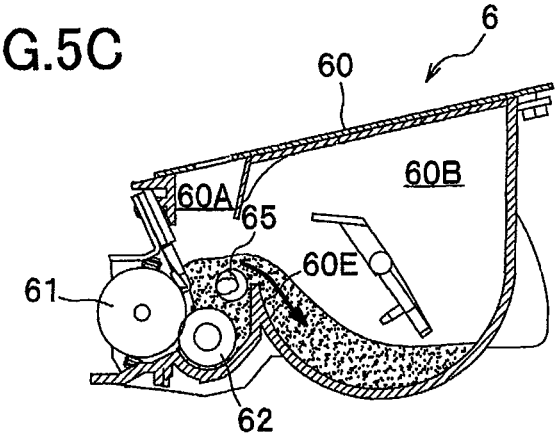
Figure 6A:
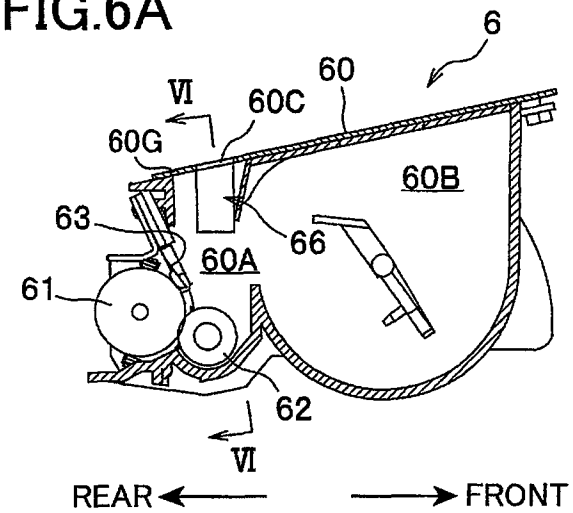
FIG. 6A is a side cross-sectional view of a developing cartridge that has a dispersing member in a supplying port.
Figure 6B:
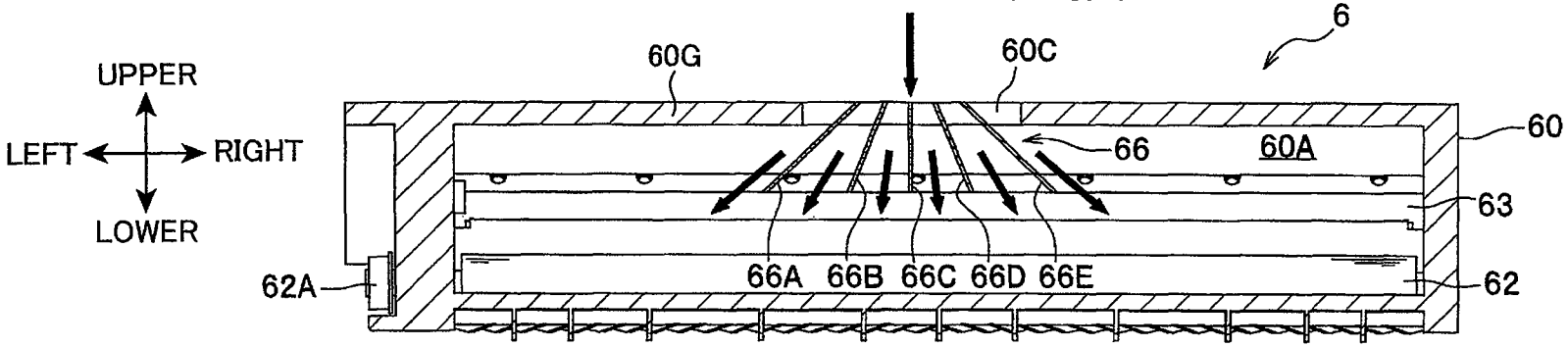
FIG. 6B is a cross-sectional view taken along line VI-VI shown in FIG. 6A.
Figure 7A:
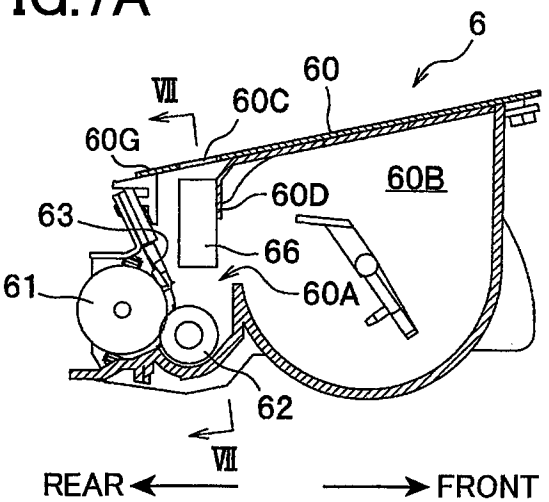
FIG. 7A is a cross-sectional view of a developing cartridge that has a dispersing member right below the supplying port.
Figure 7B:
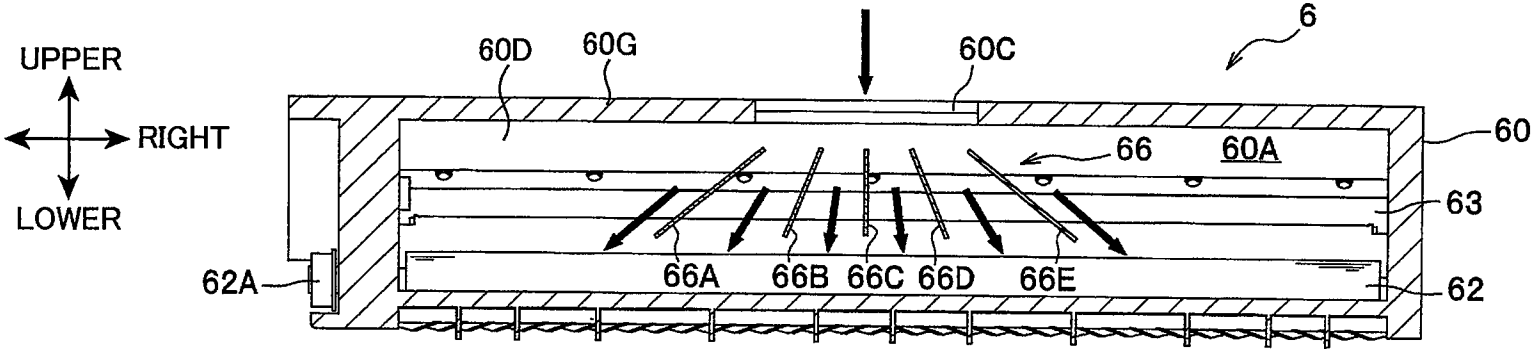
FIG. 7B is a cross-sectional view taken along line VII-VII shown in FIG. 7(*a*)
Figure 8:
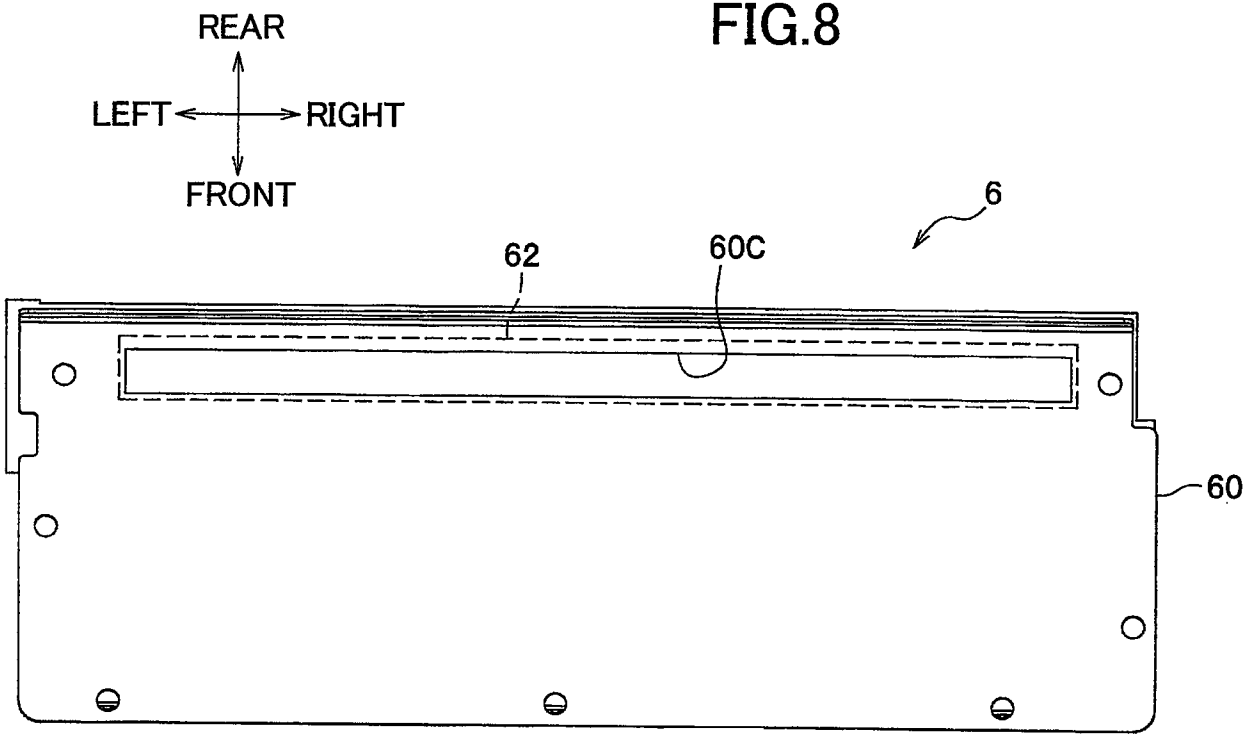
FIG. 8 is a plan view of a developing cartridge that has an elongated supplying port extending in an axial direction of a supply roller.

Developer cartridges according to modifications to the first embodiment will be described with reference to the accompanying drawings. The components of any modification, which are identical to those of the first embodiment, are designated by the same reference numbers and will not be described. FIGS. 5A to 5C are side cross-sectional views of the developing cartridges, each showing the auger located in a different position. FIG. 6A is a side cross-sectional view of a developing cartridge that has a dispersing member provided on the supplying port, and FIG. 6B is a cross-sectional view taken along line VI-VI shown in FIG. 6A. FIG. 7A is a cross-sectional view of a developing cartridge that has a dispersing member disposed right below the supplying port, and FIG. 7B is a cross-sectional view taken along line VII-VII shown in FIG. 7A. FIG. 8 is a plan view of a developing cartridge that has an elongated supplying port extending in the axial direction of the supply roller.

In the first embodiment, the auger 65 is disposed near and above the supply roller 62. However, the position of the auger 65 is not limited the position that is near and above the supply roller 62. As shown in FIG. 5A, the auger 65 may be disposed in front of the layer-thickness regulating blade 63 and in vicinity thereof. Alternatively, as shown in FIG. 5B, the auger 65 may be disposed rearward of the upper partition wall 60D and in vicinity thereof. Still alternatively, as shown in FIG. 5C, the auger 65 may be disposed rearward of the lower partition wall 60E and in vicinity thereof.

Since the auger 65 is disposed adjacent to one of the layer-thickness regulating blade 63, the upper partition wall 60D, and the lower partition wall 60E, the toner is transported, temporarily staying in a gap between the auger 65 and one of the layer-thickness regulating blade 63, the upper partition wall 60D, and the lower partition wall 60E. The toner can therefore be transported and stirred more reliably and farther from the middle part of the supply roller 62 to the left and right ends thereof, than in the case the auger 65 is disposed as if floating in the space of the developing chamber 60A (or as if separating from the layer-thickness regulating blade 63, the upper partition wall 60D, and the lower partition wall 60E).

At a portion of the auger 65 that is in confrontation with (or is closest to) one of the layer-thickness regulating blade 63, the upper partition wall 60D, and the lower partition wall 60E, the circumferential surface of the auger 65 rotates to approach one of the layer-thickness regulating blade 63, the upper partition wall 60D, and the lower partition wall 60E from above. That is, the portion of the auger 65 moves downward in the vertical direction. Therefore, the toner accumulates in the gap between the auger 65 and one of the layer-thickness regulating blade 63, the upper partition wall 60D, and the lower partition wall 60E in a greater amount. A large amount of toner can thereby be transported and stirred. If the auger 65 is disposed as shown in FIG. 5A, desirably, the auger 65 is rotated in counterclockwise direction. If the auger 65 is disposed as shown in FIGS. 5B and 5C, desirably, the auger 65 is rotated in clockwise direction.

In the first embodiment, the auger 65 is used to transport and stir the toner in the axial direction (left-to-right direction) of the supply roller 62. The present invention is not limited to this configuration. For example, the developer cartridge 6 may includes a diffusion member 66 as shown in FIGS. 6A and 6B, in place of the auger 65 (i.e., transport member).

As shown in FIGS. 6A and 6B, the diffusion member 66 is composed of five diffusion plates 66A to 66E, each being a rectangular plate. The diffusion plates 66A to 66E have upper edges, respectively, arranged at regular intervals in the replenishing port 60C along the left-to-right direction. Each of the upper edges of the diffusion plates 66A to 66E is fixed to the upper wall 60G formed with the replenishing port 60C at the front and rear ends of the replenishing port 60C.

The diffusion plate 66C extends almost vertically in the center part of the replenishing port 60C (the developing chamber 60A) in the left-to-right direction. The diffusion plate 66B is disposed on the left side of the diffusion plate 66C, and the diffusion plate 66D is disposed on the right side of the diffusion plate 66C. Further, the diffusion plate 66A is disposed on the left side of the diffusion plate 66B, and the diffusion plate 66E is disposed on the right side of the diffusion plate 66D.

The diffusion plates 66B and 66D are inclined to each other, with their lower ends spaced apart in the left-to-right direction. Similarly, the diffusion plates 66A and 66E are inclined to each other, with their lower ends more spaced apart in the left-to-right direction than those of the diffusion plates 66B and 66D.

In this configuration, the fresh toner supplied through the replenishing tube 9 (FIG. 1) flows downward (in the direction of the arrow) along the upper surfaces of the diffusion plates 66A, 66B, 66D and 66E and along the left and right surfaces of the diffusion plate 66C. As the fresh toner is diffused in the axial direction of the supply roller 62, the fresh toner can be mixed with the degraded toner in the developing chamber 60A. The diffused fresh toner and the degraded toner are stirred by the rotating supply roller 62 and are mixed uniformly as described above. The resultant mixed toner accumulates on the supply roller 62 (on the bottom surface of the developing chamber 60A) and then flows by rotating the supply roller 62. The mixed toner then flows (or sent) into the toner receptacle 60B arranged in front of the developing chamber 60A.

Further, in this configuration, when supplying the fresh toner from the toner box 8, at least the supply roller 62 need to be driven for mixing the fresh toner and the degrade toner. Hence, gears need not be provided to transmit a drive force to the auger 65 as in the first embodiment. The configuration of the drive unit 20 can therefore be simplified. Only the rotational direction or speed of the drive source 21 for rotating the supply roller 62 need be changed. In the drive-force transmitting unit 22, a movable gears or a mechanism that changes or releases the gear engagement need not be provided.

As shown in FIGS. 7A and 7B, the diffusion member 66 may be provided, for example, on the rear surface of the upper partition wall 60D in the developing chamber 60A. In this case, the diffusion member 66 is located right below the replenishing port 60C.

The phrase of "located right below the replenishing port 60C" means that the replenishing port 60C and the diffusion member 66 overlap each other, at least in part, as the replenishing port 60C viewed from above (in the vertical direction) while the process cartridge 5 (developer cartridge 6) is mounted in the main casing 2.

In order to diffuse the fresh toner supplied through the replenishing port 60C, as shown in FIG. 8, the replenishing port 60C may be formed as long as the supply roller 62 in the axial direction of the supply roller 62 (i.e., left-to-right direction). That is, the size of the replenishing port 60C in the left-to-right direction is substantially the same as that of the roller part of the supply roller 62 in the left-to-right direction. Then, the lengthwise dimensions of the port of the toner box 8 and the replenishing tube 9 may be determined based on this size of the replenishing port 60C. Accordingly, the fresh toner supplied through the replenishing port 60C can be diffused in the axial direction of the supply roller 62.

Therefore, neither the auger 65 (i.e., transport member) nor the diffusion member 66 needs to be provided in the developer cartridge 6. This can reduce the manufacturing cost of the developer cartridge 6. In addition, the drive unit 20 can be simple in structure. Hence, the cost concerning the drive unit 20, and ultimately the manufacturing cost of the laser printer 1, can be lowered.

In the embodiment described above, the process cartridge 5 is detachably mounted in the main casing 2, so that the developer cartridge 6 is indirectly mounted in the main casing 2 and removed from the main casing 2. This embodiment is not limited to this configuration. Instead, the developer cartridge 6 (developing device) may be directly mounted in the main casing 2 and be removed therefrom.

Figure 9:
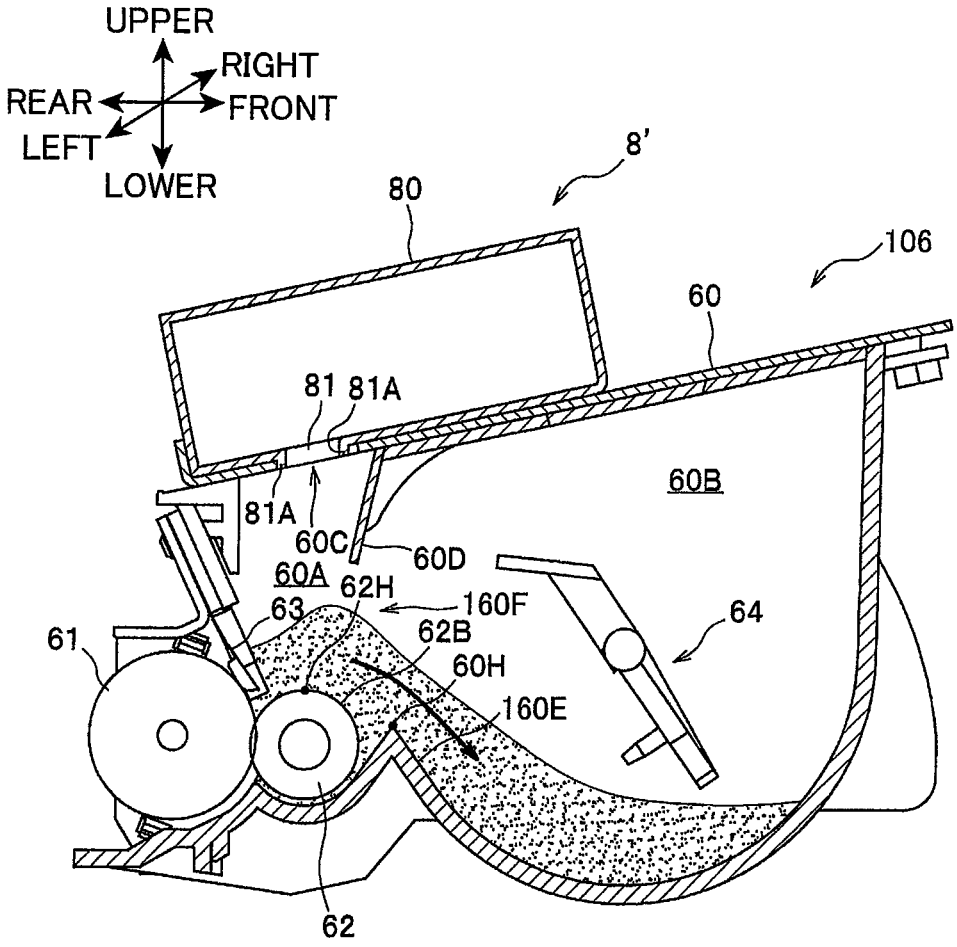
FIG. 9 is a side cross-sectional view showing the configuration of a developing cartridge according to a second embodiment of the present invention.

In the embodiment described above, the replenishing tube 9 connects the replenishing port 60C of the developer cartridge 6 to the port (not shown) of the toner box 8. Thus, the developer cartridge 6 and the toner box 8 communicate with each other via the replenishing tube 9. The above embodiment is not limited to this configuration. As shown in FIG. 9, the replenishing port 60C of the developer cartridge 6 may be directly detachably connected to the port of the toner box 8. In this case, the developer cartridge 6 (process cartridge 5) and the toner box 8 can be attached in the main casing 2 and removed from the main casing 2, at the same time, thereby improving the operability of the laser printer 1. Moreover, the apparatus can be simplified in structure and made at a low cost, because no replenishing tube need be provided in the main casing 2.

In the embodiment described above, the toner box 8 that can be detachably mounted in the main casing 2 is used as an example of the developer-replenishing device. The above embodiment is not limited to this configuration. A developer-replenishing device provided outside the main casing 2 and configured to supply toner (developer) to the developer cartridge 6 (developing device) in the apparatus via the replenishing tube may be employed.

In the embodiment described above, if the process cartridge 5 and the toner box 8 are mounted and if the front cover 2A is closed, the control unit 10 determines that "the developing device (the developer cartridge 6) is mounted in the main casing of the apparatus". The above embodiment is not limited to this. The control unit 10 may determined that "the developing device (the developer cartridge 6) is mounted in the main casing of the apparatus" if the developer cartridge 6 and the toner box 8 are mounted together in the main casing 2, when the replenishing port 60C of the developer cartridge 6 is directly detachably connected to the port of the toner box 8. Alternatively, The control unit 10 may determined that "the developing device (the developer cartridge 6) is mounted in the main casing of the apparatus" if a button on the console panel (not shown) provided on the main casing 2 is operated after the process cartridge 5 and the toner box 8 have been mounted and the front cover 2A has been closed.

[Second Embodiment]

An image forming apparatus and a developing apparatus according a second embodiment of the present invention will be described in detail, with reference to the accompanying drawings. The components identical to those of the first embodiment are designated by the same reference numerals and will not be described. FIG. 9 is a side cross-sectional view showing the configuration of a developing cartridge according to the second embodiment.

In the following description, the various directions are referred to, with respect to the plane of FIG. 9. Of the upward and downward directions, the upward direction is the direction in which fresh toner is supplied from a toner box 8' to the developer cartridge 106.

In the first embodiment described above, the developer cartridge 6 (process cartridge 5) is mounted in the main casing 2 and the control unit 10 and the drive unit 20 drive the supply roller 62, thereby the toner is supplied from the developing chamber 60A into the toner receptacle 60B. The present invention is not limited to this configuration. A structure of a developer cartridge 106 in the second embodiment alone can supply the toner from the developing chamber 60A into the toner receptacle 60B.

The total toner storage capacity of the developing chamber 60A and toner receptacle 60B of the developing case 60 is greater than the toner storage capacity of the toner box 8'. Further, the toner storage capacity of the developing chamber 60A is smaller than that of the toner box 8'.

The developing chamber 60A and the toner receptacle 60B are separated from each other by the upper partition wall 60D and a lower partition wall 160E provided in the developing case 60. The space between the upper partition wall 60D and lower partition wall 160E is a communication passage 160F, through which toner may pass back and forth between the developing chamber 60A and the toner receptacle 60B.

The supply roller 62 has an outer surface 62B. In the developer cartridge 106 according to this embodiment, the supply roller 62 is so positioned that an uppermost part 62H of the outer circumferential surface 62B locates above an upper part 60H of the lower partition wall 160E.

As shown in FIG. 9, the developing chamber 60A and the toner receptacle 60B are positioned side by side in the front-to-rear direction (horizontal direction of FIG. 9). Further, the inside of the developing chamber 60A is in communication with the outside of the developing chamber 60A through the replenishing port 60C in the vertical direction. Therefore, the communication direction of the replenishing port 60C extends intersects with the communication direction of the communication passage 160F. That is, the direction in which fresh toner passes through the port 60C intersects with the direction in which the toner passes through the communication passage 160F.

The toner box 8' has a housing 80 constituting an outer shell of the toner box 8'. The housing 80 contains fresh toner (not shown). The housing 80 has an opening portion 81. The opening portion 81 has a ring-shaped rim 81A that projects outwards. The rim 81A is fitted in the replenishing port 60C of the developer cartridge 6, whereby the toner box 8' and the developer cartridge 6 (developing chamber 60A) communicate with each other via the opening portion 81 and replenishing port 60C.

The effects of the developer cartridge 106 so configured as described above will be explained below.

When no toner remains in the developer cartridge 106 (more precisely, toner receptacle 60B), the developer cartridge 106 is removed from the main casing 2. Then, a new toner box 8' is attached to the replenishing port 60C and positioned above the developing case 60 as illustrated in FIG. 9. The fresh toner flows from the toner box 8' into the developing chamber 60A through the opening portion 81 and the replenishing port 60C and falls onto the supply roller 62. The fresh toner supplied in a large amount can therefore be uniformly mixed with the degraded toner in the developing chamber 60A.

The mixed toner accumulates on the bottom of the developing chamber 60A and on the supply roller 62, forming a hill. The hill of the mixed toner collapses as fresh toner is further supplied from the toner box 8'. In this embodiment, since the uppermost part 62H of the supply roller 62 locates above the upper part 60H of the lower partition wall 160E, the collapsed toner moves over the upper part 60H of the lower partition wall 160E and flows into the toner receptacle 60B. Therefore, the degraded toner in the mixed toner can be transported from the developing chamber 60A into the toner receptacle 60B.

Particularly in this embodiment, the communication direction of the replenishing port 60C extends intersects with the communication direction of the communication passage 160F. Therefore, the supplied fresh toner accumulates in the developing chamber 60A and mixes with the degraded toner, forming a hill, the hill collapses as fresh toner is further supplied, and the mixed toner flows into the toner receptacle 60B juxtaposed with the developing chamber 60A in the horizontal direction. Thus, the degraded toner can be mixed with the fresh toner and moved into the toner receptacle 60B, together with the fresh toner.

The developing roller 61 and layer-thickness regulating blade 63 are provided on the left side of the uppermost part 62H (see FIG. 9), extending in the longwise direction of the developer cartridge 106 (i.e., left-to-right direction in FIG. 9). Therefore, the collapsed toner cannot flow to the left side of the developing roller 61.

As described above, the developer cartridge 106 is so designed that the total toner storage capacity of the developing chamber 60A and toner receptacle 60B is greater than the toner storage capacity of the toner box 8', and the toner storage capacity of the developing chamber 60A is smaller than that of the toner box 8'. The degraded toner can be therefore moved into the toner receptacle 60B, without remaining in the developing chamber 60A.

Since the fresh toner is continuously supplied from the toner box 8' into the developing chamber 60A, in the developing chamber 60A, the degraded toner is uniformly mixed with the fresh toner and moved to the toner receptacle 60B by continuously performing the above-mentioned toner mixing process. As a result, the ratio of the degraded toner to the fresh toner can be fast reduced in the developing chamber 60A. This can quickly replace most degraded toner with the fresh toner in the developing chamber 60A.

In the developer cartridge 6 according to this embodiment, the degraded toner remaining in the developing chamber 60A is thus mixed with the fresh toner being supplied from the toner box 8'. Then, the resultant mixed toner is moved into the toner receptacle 60B. The degraded toner can thereby be replaced fast with the fresh toner. Therefore, the ratio of the degraded toner to the fresh toner can be reduced in the developing chamber 60A even immediately after the fresh toner has been supplied. This suppresses the degradation of image quality, which occurs as the fresh toner is supplied, more readily than in the conventional apparatus.

In this embodiment, the lower partition wall 160E is so shaped that the upper part 60H is pointed and both sides of the lower partition wall 160E incline downwards (thus shaped like a triangle as viewed from the side). The shape of the lower partition wall 160E is not limited to this. The lower partition wall 160E may have any other shape, so long as the lower partition wall 160E causes the collapsed toner in the developing chamber 60A to flow smoothly into the toner receptacle 60B. The toner receptacle 60B may have, for example, almost vertical walls. Alternatively, the upper part 60H may have a specific width (the lower partition wall 160E may therefore appear trapezoidal as viewed from the side). Still alternatively, the side surfaces of the lower partition wall 160E may be curved like an arc or formed linearly.

With this embodiment, desirably, the fresh toner is supplied while driving the supply roller 62 after the developer cartridge 6 and toner box 8' have been mounted in the main casing 2, in the same way as in the first embodiment. In this case, the fresh toner may be supplied from a toner box (i.e., developer-replenishing device) provided outside the main casing 2 via a replenishing tube into the developer cartridge 6 (developing device) provided in the main casing 2.

While the invention has been described in detail with reference to specific embodiments thereof, it would be apparent to those skilled in the art that many modifications and variations may be made therein without departing from the spirit of the invention, the scope of which is defined by the attached claims.

In the embodiments described above, the developing chamber 60A and the toner receptacle 60B are arranged side by side in the front-to-rear direction (horizontal direction). The present invention is not limited to this configuration. That is, the phrase "arranged side by side in the horizontal direction" means that the developing chamber and the toner receptacle partially overlap in the horizontal direction, while the developing device is mounted in the main casing 2 (or while the toner is being supplied).

In the embodiments described above, the replenishing port 60C is formed right above the supply roller 62. The phrase of "formed right above the replenishing port 60C" means that the replenishing port 60C and the supply roller 62 partially overlap each other as the replenishing port 60C viewed from above (in the vertical direction) while the process cartridge 5 (developer cartridge 6) is mounted in the main casing 2.

The position the replenishing port 60C is not limited to "right above the supply roller 62". The replenishing port 60C may be formed any position above the supply roller 62. In this case, desirably, a member that reliably makes toner fall from the replenishing port 60C onto the supply roller 62 is provided. For example, an auger may be arranged between the replenishing port 60C and the supply roller 62 and the toner may be made to fall from the auger onto the supply roller 62. Alternatively, a member (e.g., upper partition wall having an inclined surface) may be used to supply toner onto the supply roller 62.

In the embodiments described above, the replenishing port 60C is formed in the center part of the upper wall 60G of the developing chamber 60A as illustrated in FIG. 3A. The present invention is not limited to this configuration. The replenishing port 60C may be formed in the left or right part of the upper wall 60G. In this case, the transport member (e.g., auger) or the diffusion member is changed in configuration or position.

In the embodiments described above, the developer cartridge 6 is used as an example of a developing device. The present invention is not limited to this. For example, the process cartridge 5 described above may be used as developing device in the present invention.

The embodiments described above have the laser printer 1 as an example of an image forming apparatus. Nonetheless, the image forming apparatus according to the present invention is not limited to the laser printer 1. This invention can be applied to multi-function apparatuses or copying apparatuses. Moreover, the present invention can be applied to an image forming apparatus having a plurality of developing devices, for example, color printers, color multi-function apparatuses and color copiers.

What is claimed is:

1. An image forming apparatus comprising:

a main casing;

a developing apparatus that is detachably mountable in the main casing and that comprises:

a casing that defines a developing chamber and a developer accommodating chamber, the developer accommodating chamber configured to accommodate developer therein, the developing chamber and the developer accommodating chamber being arranged side by side, the casing being formed with a replenishing port for supplying new developer from a developer replenishing unit into the developing chamber, the developer replenishing unit configured to accommodate the new developer, wherein a total developer storage capacity of the developing chamber and the developer accommodating chamber is greater than a developer storage capacity of the developer replenishing unit;

an agitator disposed in the developer accommodating chamber, and configured to rotate in the casing to supply developer from the developer accommodating chamber to the developing chamber; and a supply roller disposed in the developing chamber, the replenishing port being located above the supply roller when the developing apparatus is disposed in an orientation in which the developing apparatus is intended to be placed in the main casing; and a control unit configured to:

control the supply roller to rotate when the developing apparatus is mounted in the main casing, the supply roller stirring old developer that has already been located in the developing chamber and the new developer, and transporting the old developer and the new developer from the developing chamber into the developer accommodating chamber; and stop the agitator from rotating while the supply roller is being controlled to rotate.

2. The image forming apparatus according to claim 1, wherein the developing chamber and the developer accommodating chamber are arranged side by side in a horizontal direction when the developing apparatus is disposed in the orientation.

3. The image forming apparatus according to claim 1, wherein the developer storage capacity of the developer replenishing unit is greater than a developer storage capacity of the developing chamber.

4. The image forming apparatus according to claim 1, wherein the casing is formed with a communication passage through which the developing chamber is in communication with the developer accommodating chamber, wherein the replenishing port has a communication direction corresponding to a vertical direction when the developing apparatus is disposed in the orientation, and wherein the communication passage has a communication direction corresponding to the horizontal direction when the developing apparatus is disposed in the orientation.

5. The image forming apparatus according to claim 1, wherein the supply roller defines an axial direction, and wherein the developing apparatus further comprises a transport member that is disposed in the developing chamber and transports the new developer along the axial direction of the supply roller.

6. The image forming apparatus according to claim 5, wherein the developing apparatus further comprises a developing roller that carries developer thereon and is disposed in the developing chamber, and a thickness regulating blade that regulates a thickness of developer on the developing roller, wherein the transport member is an auger that is positioned adjacent to the thickness regulating blade.

7. The image forming apparatus according to claim 5, wherein the transport member is an auger that is disposed adjacent to the supply roller.

8. The image forming apparatus according to claim 5, wherein the casing includes a first wall, a second wall that is positioned at a lower side of the first wall when the developing apparatus is disposed in the orientation, and a first partition wall that extends from the first wall toward the second wall, the first partition wall being interposed between the developing chamber and the developer accommodating chamber, and wherein the transport member is an auger that is disposed adjacent to the first partition wall.

9. The image forming apparatus according to claim 5, wherein the casing includes a first wall, a second wall that is positioned at a lower side of the first wall when the developing apparatus is disposed in the orientation, and a second partition wall that extends from the second wall toward the first wall, the second partition wall being interposed between the developing chamber and the developer accommodating chamber, and wherein the transport member is an auger that is disposed adjacent to the second partition wall.

10. The image forming apparatus according to claim 5, wherein the transport member is an auger, and wherein at least a part of the auger overlaps the replenishing port in a vertical direction when the developing apparatus is disposed in the orientation.

11. The image forming apparatus according to claim 1, wherein the supply roller defines an axial direction, and wherein the developing apparatus further comprises a diffusion unit that diffuses the new developer along the axial direction of the supply roller.

12. The image forming apparatus according to claim 11, wherein a part of the diffusion unit is located in the replenishing port.

13. The image forming apparatus according to claim 11, wherein the diffusion unit is located right below the replenishing port.

14. The image forming apparatus according to claim 1, wherein the supply roller defines an axial direction, and wherein the replenishing port has an elongated shape extending in the axial direction of the supply roller.

15. The image forming apparatus according to claim 1, wherein the developer replenishing unit is detachably mountable on the casing for directly supplying the new developer from the developer replenishing unit to the developing chamber through the replenishing port.

16. The image forming apparatus according to claim 1, wherein the developer replenishing unit includes a replenishing tube having one end portion, the one end portion being connected to the replenishing port, the new developer being supplied from the developer replenishing unit to the developing chamber through the replenishing tube and the replenishing port.

* * * * *